United States Patent [19]

Muise

[11] Patent Number: 4,526,315

[45] Date of Patent: Jul. 2, 1985

[54] TRAY WITH PARTITIONS FORMED FROM SIDEWALLS

[75] Inventor: Herbert D. Muise, Orange, Calif.

[73] Assignee: Weyerhaeuser Company, Tacoma, Wash.

[21] Appl. No.: 642,329

[22] Filed: Aug. 20, 1984

[51] Int. Cl.[3] ..... B65D 5/48

[52] U.S. Cl. ..... 229/27; 229/15; 229/32

[58] Field of Search ..... 229/15, 27, 42, 30, 229/32, 28 R

[56] References Cited

U.S. PATENT DOCUMENTS

| | | | |
|---|---|---|---|
| 887,789 | 5/1908 | Greene | 229/42 |
| 2,743,730 | 5/1956 | Heaton | 229/28 R X |
| 2,796,213 | 6/1957 | Shanahan | 229/42 |
| 2,958,452 | 11/1960 | Kuchenbecker | 229/15 |
| 3,014,632 | 12/1961 | Kuchenbecker | 229/15 |
| 3,236,433 | 2/1966 | Barrett et al. | 229/15 |
| 3,327,919 | 6/1967 | Kim | 229/15 |
| 3,384,289 | 5/1968 | Grant | 229/15 |
| 3,519,191 | 7/1970 | Royce | 229/42 |
| 3,702,170 | 11/1972 | Adams | 229/42 X |
| 3,958,745 | 5/1976 | Lindsay | 229/15 |
| 3,963,169 | 6/1976 | Gardner | 229/15 X |
| 3,963,171 | 6/1976 | Lindsay | 229/15 X |
| 3,980,223 | 9/1976 | Curran | 229/28 R |
| 4,077,561 | 3/1978 | Gardner | 229/15 X |
| 4,120,443 | 10/1978 | Gardner et al. | 229/15 X |

FOREIGN PATENT DOCUMENTS

| | | | |
|---|---|---|---|
| 2353222 | 4/1975 | Fed. Rep. of Germany | 229/27 |

*Primary Examiner*—William Price
*Assistant Examiner*—Gary E. Elkins

[57] ABSTRACT

A partitioned tray formed from a single unitary blank in which the partitions are formed from the side walls. Each of the side walls has three sections, two side wall sections and a partition section which is hinged to one of the side wall sections. A triangular toggle panel is formed in the bottom panel and is hinged to the partition panel and the bottom panel. The triangular bottom panel is an isosceles triangle.

4 Claims, 3 Drawing Figures

TRAY WITH PARTITIONS FORMED FROM SIDEWALLS

BACKGROUND OF THE INVENTION

There are a number of pads or trays with unitary partitions. Exemplary of the various styles are Barrett, et al., U.S. Pat. No. 3,236,433 granted Feb. 22, 1966; Kim, U.S. Pat. No. 3,327,919 granted June 27, 1967; Kuchenbecher, U.S. Pat. Nos. 2,958,452 granted Nov. 1, 1960 and 3,014,632 granted Dec. 26, 1961; Shanahan, U.S. Pat. No. 2,796,213 granted June 18, 1957; Curran, U.S. Pat. No. 3,980,223 granted Sept. 14, 1976; Royce, U.S. Pat. No. 3,519,191 granted July 7, 1970; and Grant, U.S. Pat. No. 3,384,289 granted May 21, 1968.

SUMMARY OF THE INVENTION

Most of the prior art partitioning sections are difficult to form and place in the container. The inventor needed a tray and partitions which were integral and in which the partitions could be placed and held in position easily. He devised a tray in which the partitions are formed from sections of the side wall of the tray and which may easily be placed into position and are held in position by toggle panels. Multiple elements are no longer needed. The partition and tray use only the same amount of material as the tray alone because the partitions are part of the side wall. Enough of the side wall is left to keep the contained product within the tray. The tray may then be placed into an outer corrugated container or may be wrapped in plastic.

BRIEF DESCRIPTIONS OF THE DRAWINGS

DETAILED DESCRIPTION OF THE PREFERRED EMBODIMENT

Figure 1:
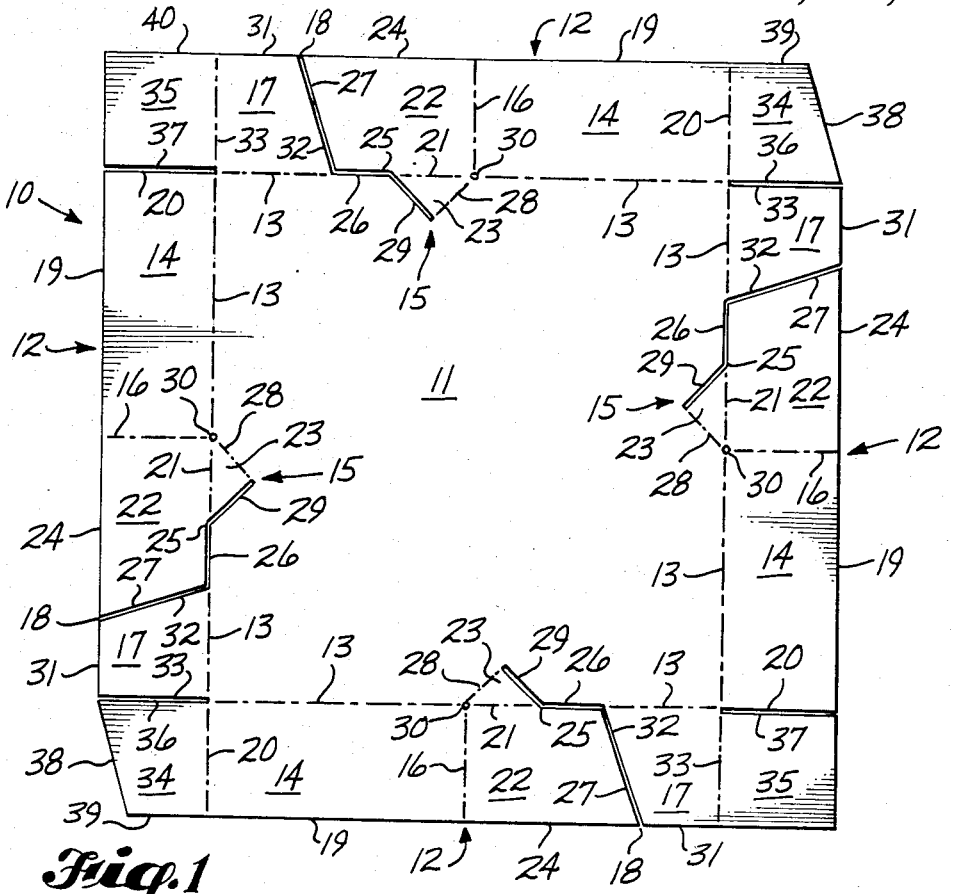
FIG. 1 is a top plan view of the blank for the container.

The blank 10, shown in FIG. 1, has a bottom panel 11. Four side walls 12 are attached hingedly along score lines 13 to the four sides of bottom panel 11.

The side walls 12 are of the same construction. Each is divided into three sections. Each has a first side wall section 14 which is attached to the bottom panel 11 along the score line 13; a partition panel section 15 which is hinged to first side wall section 14 along a score line 16; and a second side wall section 17 which is separated from the partition panel section 15 by a cut line or slit 18. Cut line or slit 18 may be perpendicular to score line 13 or at an oblique angle to score line 13.

The first side wall section 14 is rectangular. Its outer edge 19 is parallel to its inner edge 13. Its inner side edge 16 and its outer side edge 20 are both perpendicular to the score line 13 which attaches the section to the bottom panel 11.

The partition panel section 15 is divided by a score line 21 into a partition panel 22 and a toggle panel 23. The score line 21 is offset slightly outwardly and parallel to the score line 13.

The partition panel 22 may be rectangular or trapezoidal. The outer edge 24 of the partition panel 22 is parallel to the inner edge 25 of the panel 22. The inner edge 25 is formed by the score line 21 and the cut line or slit 26 which extends between the score line 21 and the cut line or slit 18. The cut line 26 is aligned with score line 21. The outer side edge 27 formed by cut line 18 may be perpendicular to or at an oblique angle to inner and outer edges 24 and 25. The inner side edge 16 is perpendicular to the adjacent score line 13. The trapezoidal style shown allows a larger viewing area of the contained product. In this style the outer edge 24 of the partition panel 22 is longer than the inner edge 25, and the outer side edge 27 is at an oblique angle to inner and outer edges 24 and 25.

The toggle panel 23 is an isosceles triangle formed from the bottom panel 11 by score line 21, score line 28 and cut line or slit 29. Score line 28 and cut line 29 are of equal length. Score line 21 is shown as slightly longer than one half the length of the inner side 25 of partition panel 22. Score line 21 is long enough to provide a good supporting hinge with partition panel 22. The angles between score line 21 and both slit 29 and score line 28 are equal. The angle will depend on the placement of the particular panel 22 in the tray. If the partition panel 22 is perpendicular to side wall section 14 than the two angles will be 45°. If the partition panel 22 is at an obtuse angle to section 14, then the angles will be less than 45°; if partition panel 22 is at an acute angle to section 14, then the angles will be greater than 45°. The score lines 13, 16, 21 and 28 meet at a common point 30. Point 30 is an aperture to aid the toggle panel 23 to be bent into place.

The second side wall section 17 may also be rectangular or trapezoidal. The outer edge 31 is parallel to the inner edge formed by the score line 13 and is shorter than the inner edge. The inner side edge 32 formed by cut line 18 may be perpendicular to or at an oblique angle to the outer and inner edges 11 and 13. The outer side edge 33 is perpendicular to the outer and inner edges 11 and 13.

Connecting corner flaps 34 and 35 are attached to the outer side edges of one opposed pair of side walls 12. Corner flap 34 is attached hingedly to first side panel section 14 along score line 20. Corner flap 35 is attached hingedly to second side wall panel section 17 along score line 33. Corner flap 34 is separated from the adjacent second side panel section 17 by cut line or slot 36. Corner flap 35 is separated from the adjacent first side panel section 14 by cut line or slot 37.

Corner flap 34 is shown as identical in size and shape to the adjacent second side panel section 17, having an oblique outer side edge 38 and being congruent with section 17 when flap 34 and section 17 are adhered together. Corner flap 34 may be smaller than section 17.

Figure 2:
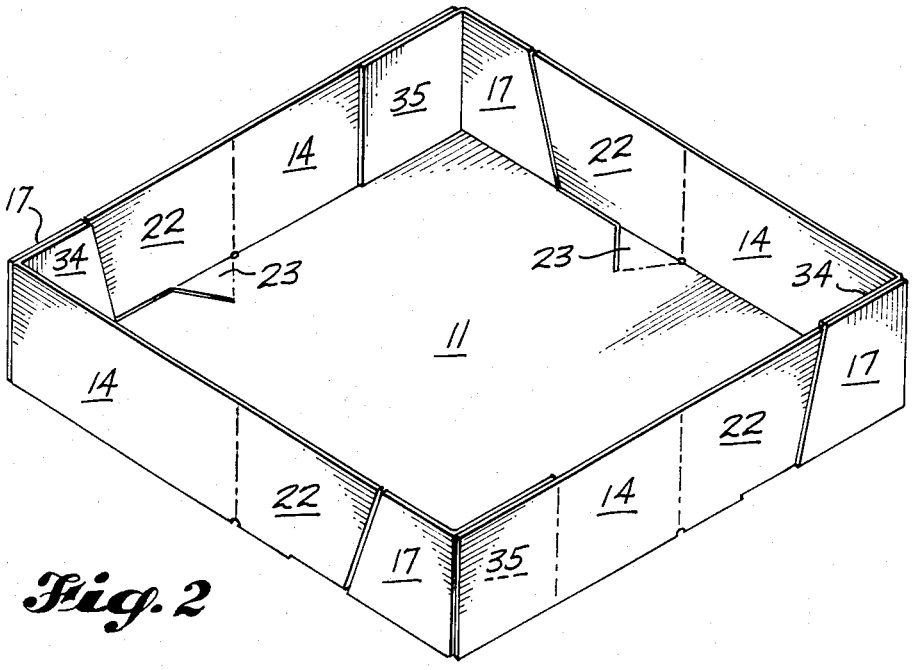
FIG. 2 is an isometric view of the tray with the partition panels in alignment with the side walls.

The tray is formed as shown in FIG. 2 by bending the corner flaps 34 and 35 inwardly around score lines 20 and 33, respectively, and then bending the side walls 12 upwardly around score line 13. Each of the corner flaps 35 is adhered to the adjacent first side wall section 14 and each of the corner flaps 34 is adhered to the adjacent second side wall section 17.

Figure 3:
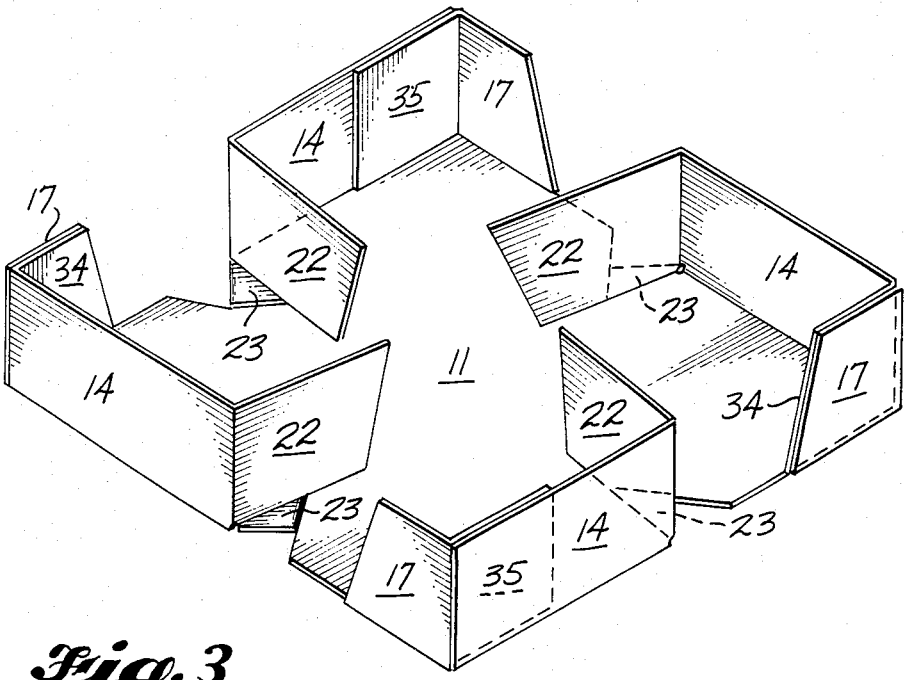
FIG. 3 is an isometric view of the tray with the partition panels in place.

The partitions are placed in position as shown in FIG. 3 by bending the partition panels 22 inwardly around score line 16. This causes the toggle panel 23 to bend inwardly around score lines 28 and 21 until it overlies the bottom panel 11. The toggle panel 23 then holds the partition panel 22 in place within the tray.

The outer edges 39 of corner flap 34, 19 of first side wall section 14, 24 of partition panel 22, 31 of second side wall section 17 and 40 of corner flap 35 in each side wall section are in alignment.

I claim:

1. A blank for a partitioned tray comprising a bottom panel;

side walls;

each of said side walls comprising first and second side wall sections, each of said side wall sections being attached to said bottom panel by first score lines;

a partition panel between said first and second side wall sections, said partition panel being hingedly attached to said first side wall section by a second score line, said partition panel being separated from said second side wall section by a first cut line and from said bottom panel by a second cut line;

a toggle panel formed in said bottom panel, said toggle panel being hingedly attached to said partition panel along a third score line extending between said second cut line and said second score line; and hingedly attached to said bottom panel along a fourth score line, said second, third and fourth score lines meeting in a point, said toggle panel being separated from said bottom panel by a third cut line extending between the outer ends of said third and fourth score lines.

2. The blank of claim 1 in which said fourth score line and said second cut line are of equal length.

3. A tray comprising a bottom panel;

side walls;

each of said side walls comprising first and second side wall sections, each of said side wall sections being attached to said bottom panel by first score lines;

a partition panel between said first and second side wall sections, said partition panel being hingedly attached to said first side wall section by a second score line, said partition panel being separated from said second side wall section by a first cut line and from said bottom panel by a second cut line;

a toggle panel formed in said bottom panel, said toggle panel being hingedly attached to said partition panel along a third score line extending between said second cut line and said second score line; and hingedly attached to said bottom panel along a fourth score line, said second, third and fourth score lines meeting in a point, said toggle panel being separated from said bottom panel by a third cut line extending between the outer ends of said third and fourth score lines.

4. The tray of claim 3 in which said fourth score line and said second cut line are of equal length.

* * * * *